US008752472B1

(12) United States Patent
Lukman et al.

(10) Patent No.: US 8,752,472 B1
(45) Date of Patent: Jun. 17, 2014

(54) RECOIL REDUCTION APPARATUS AND METHOD FOR WEAPON

(71) Applicants: Hansen Lukman, Parsippany, NJ (US); Kevin Russell, Jersey City, NJ (US)

(72) Inventors: Hansen Lukman, Parsippany, NJ (US); Kevin Russell, Jersey City, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 0 days.

(21) Appl. No.: 13/738,245

(22) Filed: Jan. 10, 2013

(51) Int. Cl.
*F41A 5/24* (2006.01)
*F41A 5/18* (2006.01)

(52) U.S. Cl.
CPC .... *F41A 5/24* (2013.01); *F41A 5/18* (2013.01)
USPC ..... 89/191.01; 89/198

(58) Field of Classification Search
CPC ..... F41A 5/18; F41A 5/30; F41A 5/20; F41A 5/22; F41A 5/24; F41A 5/26; F41A 5/28
USPC ..... 89/191.01, 191.02, 193, 198
See application file for complete search history.

(56) References Cited

U.S. PATENT DOCUMENTS

| | | | | |
|---|---|---|---|---|
| 4,269,109 | A * | 5/1981 | Stoner | 89/198 |
| 4,467,697 | A * | 8/1984 | Witt et al. | 89/37.14 |
| 2013/0036900 | A1* | 2/2013 | Mueller | 89/191.01 |

* cited by examiner

*Primary Examiner* — Stephen M Johnson
(74) *Attorney, Agent, or Firm* — Michael C. Sachs

(57) ABSTRACT

A reduced recoil weapon includes a housing and a receiver translatably disposed in the housing. A barrel is fixed to the receiver. A pair of recoil rods has first ends that are fixed to the receiver and are translatable with respect to the housing. Recoil springs are disposed around each recoil rod with first ends of the recoil springs abutting a forward surface of the housing. A bolt and bolt carrier are translatably disposed in the receiver. A bolt carrier return spring is disposed in the housing between the bolt carrier and a rear surface of the housing. Gas pressure from a gas piston on the barrel translates an operating rod toward the bolt carrier. An operating rod spring disposed in the receiver biases the operating rod toward the gas piston.

17 Claims, 5 Drawing Sheets

RECOIL REDUCTION APPARATUS AND METHOD FOR WEAPON

STATEMENT OF GOVERNMENT INTEREST

The inventions described herein may be manufactured, used and licensed by or for the United States Government.

CROSS-REFERENCE TO RELATED APPLICATIONS

The present application has the same assignee as U.S. Pat. No. 8,297,174 issued on Oct. 30, 2012 and entitled "Apparatus and Method for Gun Recoil Mitigation," and U.S. application Ser. No. 13/165,192 filed on Jun. 21, 2011 now U.S. Pat. No. 8,418,389 and entitled "Recoil Reduction Apparatus and Method for Weapon." The entire contents of U.S. Pat. No. 8,297,174 and U.S. application Ser. No. 13/165,192 are incorporated by reference herein.

BACKGROUND OF THE INVENTION

The invention relates in general to recoil reduction in weapons and in particular to recoil reduction in small and medium caliber weapons.

Traditional weapons may include an operating group having, for example, a bolt carrier and its subcomponents. The operating group recoils toward the user in order to cycle the weapon. Typically, the operating group may impact a surface at the end of its stroke. The impact may cause a "kick" that may be felt by the user. In some instances, many rounds of ammunition may be fired by an individual in a short period of time. The kick of the weapon may be painful or harmful to the user, particularly when using semi-automatic or automatic weapons. Many devices and methods have been used to minimize or eliminate kick. Some of these devices are not be desirable because they add too much weight to the weapon or are too costly.

Conventional methods for mitigating weapon recoil include muzzle brakes, breech venting, improved buttstock designs, improved buffer designs and bolt/slide designs that redirect bolt momentum. Because both gas venting momentum and operating group momentum may contribute to recoil, conventional recoil mitigation methods may, at best, only partially mitigate recoil. Partial mitigation of recoil may occur because the conventional methods do not address both the momentum produced by venting gases and the momentum produced by the operating group. Thus, a need exists for an apparatus and method to mitigate recoil caused by both gas venting momentum and operating group momentum.

There is a long-felt and unsolved need for an effective recoil reduction apparatus that adds little or no weight to a weapon and is relatively inexpensive. This need is particularly great for automatic and semi-automatic weapons.

SUMMARY OF INVENTION

One aspect of the invention is a weapon having a forward end and a rear end, a housing and a receiver translatably disposed in the housing. One end of a barrel is fixed to the receiver. The barrel is translatable with respect to the housing. A pair of recoil rods has first ends that are fixed to the receiver on opposite sides of the barrel. The recoil rods are translatable with respect to the housing and parallel to the barrel. Respective recoil springs are disposed around each recoil rod with first ends of the recoil springs abutting a forward surface of the housing.

A bolt and bolt carrier are translatably disposed in the receiver. A bolt carrier return spring is disposed in the housing between the bolt carrier and a rear surface of the housing. A gas chamber is disposed on the barrel. The gas chamber includes a piston and a gas port. The gas port includes an opening therein. An operating rod is translatably disposed in the opening in the gas port and translatable by the gas piston toward the bolt carrier. An operating rod spring is disposed in the receiver. The operating rod spring biases the operating rod toward the gas piston.

A bolt carrier return rod may be disposed inside the bolt carrier return spring and extend between the bolt carrier and the rear surface of the housing.

The operating rod and the piston may not be fixed to each other. The operating rod may include a spring stop. The operating rod may be disposed inside the operating rod spring and the operating rod spring may be fixed between the spring stop and a surface of the receiver.

Another aspect of the invention is a method that includes providing a weapon, firing a round in the weapon, and then translating the barrel and the receiver of the weapon rearward in unison with respect to the housing of the weapon. The operating rod of the weapon is translated rearward with respect to the housing and into contact with the bolt carrier. The bolt and bolt carrier are translated rearward with respect to the housing until the bolt carrier impacts the rear surface of the receiver. The operating rod is translated forward into contact with the piston and the bolt carrier and bolt are translated forward.

The step of translating the operating rod rearward with respect to the housing and into contact with the bolt carrier may be performed using propellant gas operating on the piston.

The step of translating the bolt and the bolt carrier rearward with respect to the housing until the bolt carrier impacts the rear surface of the receiver may be performed using force applied by the operating rod.

The step of translating the operating rod forward into contact with the piston may be performed using the operating rod spring.

The step of translating the bolt carrier and the bolt forward may be performed using the bolt carrier return spring.

The invention will be better understood, and further objects, features and advantages of the invention will become more apparent from the following description, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION

A weapon with a novel recoil reduction apparatus reduces peak recoil produced from firing ammunition. Peak recoil can be reduced without the expense of adding weight to the overall weapon system. In other words, compared to a known weapon that fires the same ammunition, the inventive weapon generates lower peak recoil while also weighing the same or less. The recoil reduction weapon does not require the use of a counterweight. The recoil reduction weapon may fire ammunition in a variety of modes, for example, single-shot, burst, semi-automatic and automatic. The weapon design principle is not limited to a single caliber of weapon and is scalable over a range of calibers. In some embodiments, the design principle is embodied in small and medium caliber weapons.

The combination of a translatable receiver and a gas-powered operating rod enables the weapon to reduce peak recoil. The translatable receiver allows the receiver to translate freely within the housing when the cartridge is fired. The rearward moving receiver compresses the recoil springs, thereby distributing the recoil energy over a longer period of time. Once the receiver has reached the end of its rearward stroke, the recoil springs return the receiver to its forward position. Meanwhile, the gas system in the weapon redirects gases produced from propelling the bullet to push on an operating rod that separates the bolt-carrier from the barrel. This separation enables the bolt to move rearward with respect to the recoiling receiver and enables extraction of the spent case and chambering of a new cartridge during counter recoil.

The combination of the translatable receiver and the gas-powered operating rod distributes the recoil energy over a longer portion of the weapon cycle, thereby reducing the overall peak recoil forces. Overall peak recoil forces are a source of poor accuracy, fatigue, and injury among shooters of weapons.

Figures 1, 2:
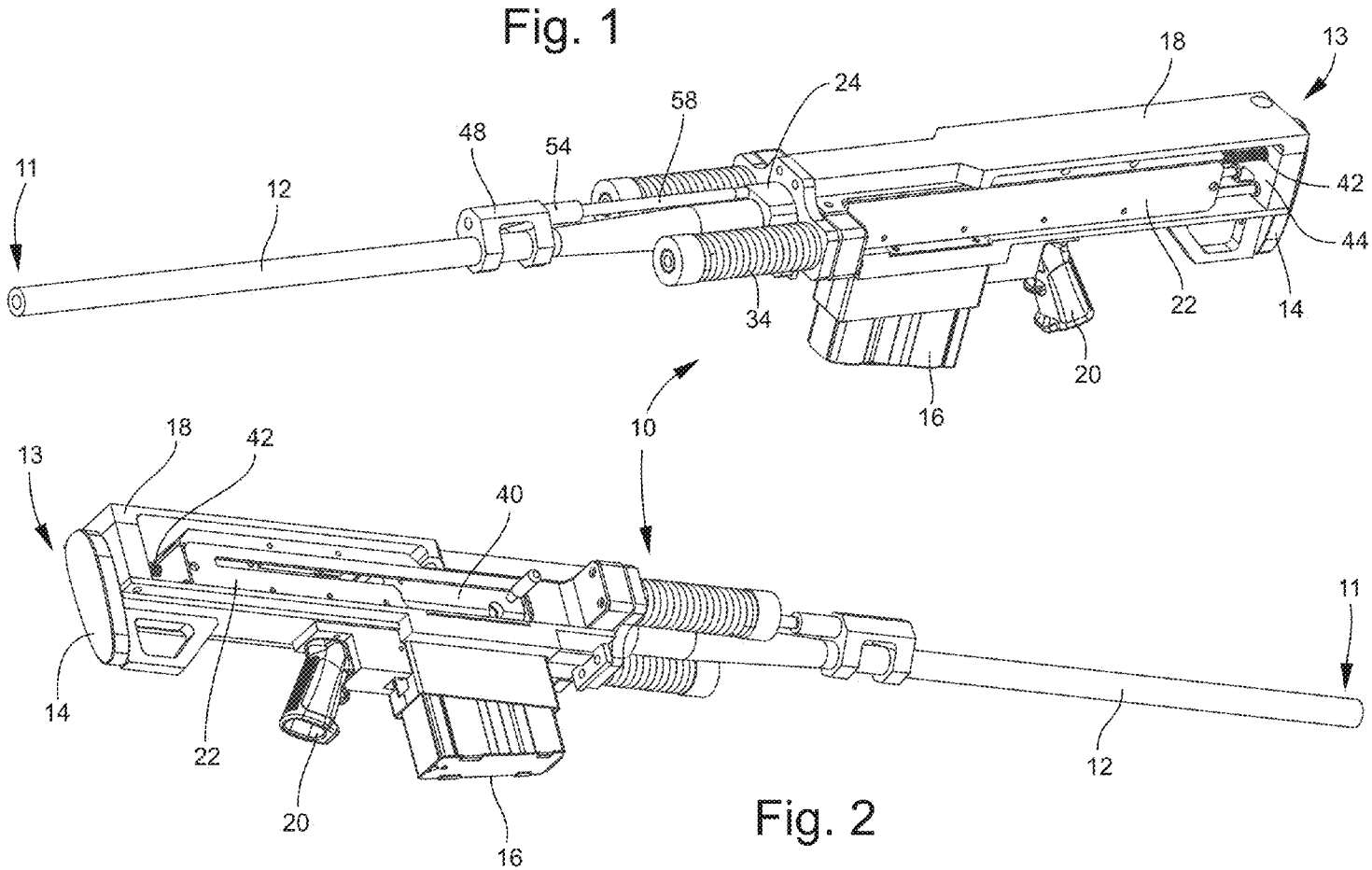
FIG. 1 is a perspective view of one embodiment of a weapon with a recoil reduction apparatus.
FIG. 2 is a perspective view of the weapon of FIG. 1 from the opposite side.
Figure 3:
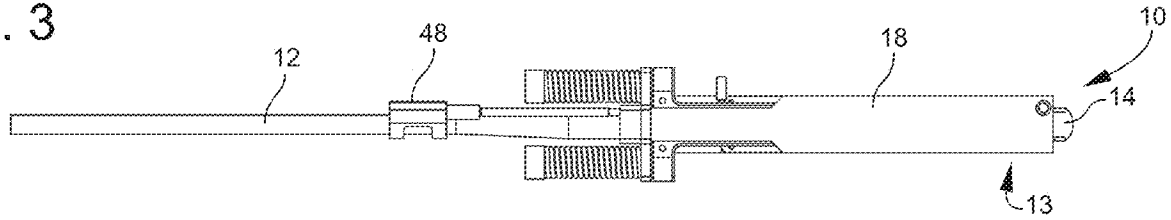
FIG. 3 is a top view of FIG. 1.
Figure 4:
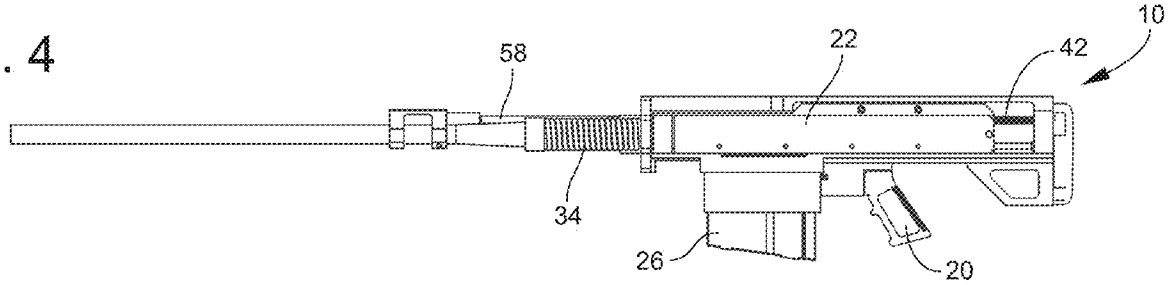
FIG. 4 is a side view of FIG. 3.
Figure 5:
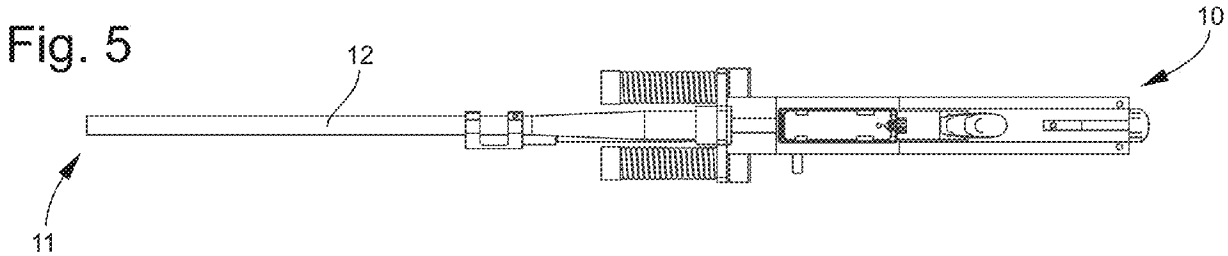
FIG. 5 is a bottom view of FIG. 3.
Figure 6:
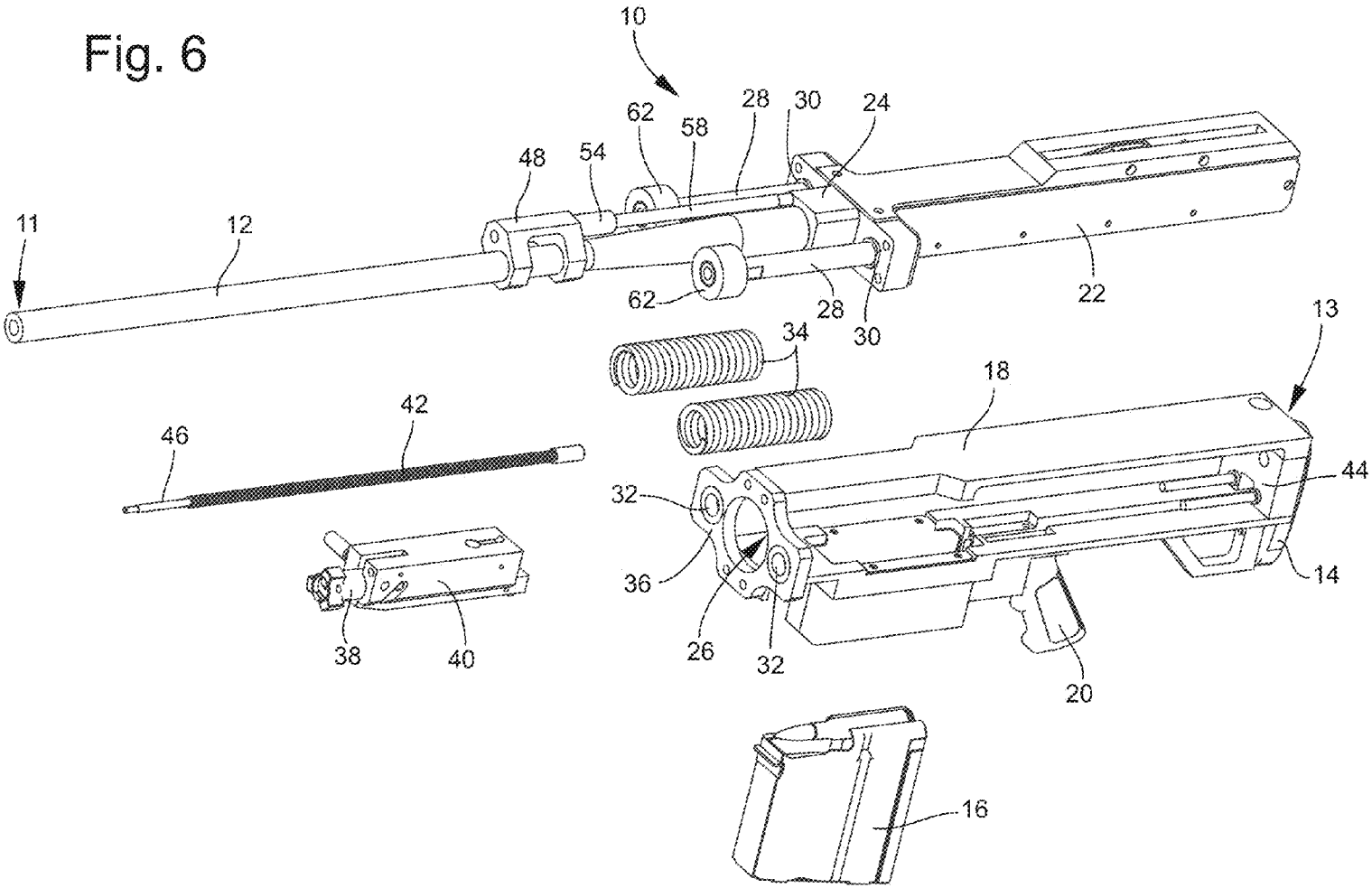
FIG. 6 is an exploded view of the weapon of FIG. 1.

FIGS. 1-5 are exterior views of one embodiment of a recoil reduction weapon 10 having a forward (muzzle) end 11 and a rear (butt) end 13. FIG. 6 is an exploded view of weapon 10. Referring to FIGS. 1-6, weapon 10 includes a housing 18 and a receiver 22 translatably disposed in housing 18. A barrel 12 has one end fixed to receiver 22, for example, in area 24 of receiver 22. Barrel 12 is translatable with respect to housing 18 through an opening 26 (FIG. 6) in housing 18. As seen in FIG. 6, a pair of recoil rods 28 has first ends 30 that are fixed to receiver 22 and are disposed on opposite sides of barrel 12. Recoil rods 28 are translatable with respect to housing 18 through openings 32 in housing 18. Recoil rods 28 are parallel to barrel 12. A recoil spring 34 is disposed around each recoil rod 28. One end of each recoil spring 34 abuts a forward surface 36 of housing 18 and the other end of each recoil spring 34 is restrained by a spring stop 62.

A bolt 38 and bolt carrier 40 are translatably disposed in receiver 22. A bolt carrier return spring 42 is disposed between a rear surface of bolt carrier 40 and a rear surface 44 of housing 18. Bolt carrier return spring 42 may be disposed around a rod 46 (FIG. 6) to prevent buckling of spring 42.

Figure 7:
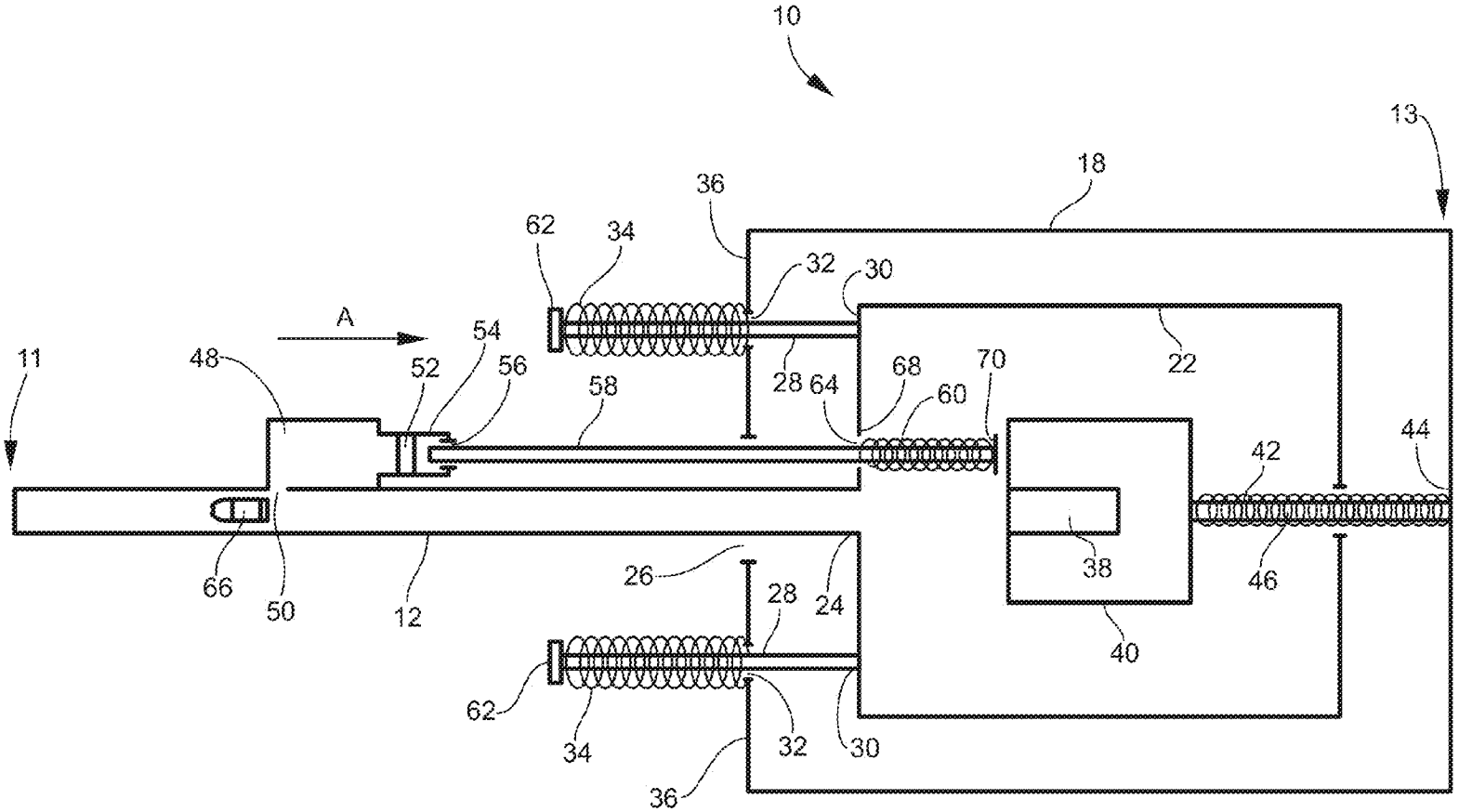
FIG. 7 is a functional schematic diagram of one embodiment of a gas system and operating rod.

As seen in FIG. 6, a gas chamber 48 is disposed on barrel 12. FIG. 7 is a functional schematic diagram of weapon 10 showing one embodiment of the gas system and operating rod. The relative proportions and sizes of the components in FIG. 7 are different from FIGS. 1-6. A gas port 50 formed in barrel 12 enables propellant gas to enter gas chamber 48 after a fired round 66 has passed by port 50. A piston 52 is translatably disposed in a gas port 54 fixed to gas chamber 48. Gas pressure in chamber 48 causes piston 52 to move in the direction of the arrow A in FIG. 7. Gas port 54 includes an opening 56 in which an operating rod 58 translates. Mechanical contact between piston 52 and rod 58 causes rod 58 to translate in the direction of arrow A toward bolt carrier 40. Operating rod 58 also translates through, for example, opening 26 in forward end of housing 18 and an opening 64 in forward end of receiver 22. An operating rod spring 60, such as a tension spring, is disposed around operating rod 58 and fixed between a spring stop 70 on the end of rod 58 and a surface 68 of receiver 22. Operating rod spring 60 biases operating rod 58 away from bolt carrier 40 and toward gas piston 52.

Firing a cartridge in weapon 10 produces a recoil force that causes barrel 12, gas chamber 48, piston 52, operating rod 58 and receiver 22 to all translate together rearward (direction of arrow A) against the force of recoil springs 34. After fired round 66 passes by barrel gas port 50, propellant gas enters gas chamber 48 and impinges on piston 52. Piston 52 contacts operating rod 58 and moves operating rod 58 rearward such that operating rod 58 contacts bolt carrier 40 and moves bolt carrier 40 rearward, thereby disengaging bolt 38 from barrel 12. Operating rod 58 is not mechanically fixed to piston 52. Depending on the caliber of weapon 10, operating rod 58 may translate rearward the same or more than piston 52. Rearward translation of operating rod 58 is constrained by operating rod spring 60.

As bolt 38 and bolt carrier 40 move rearward, the spent cartridge in barrel 12 is extracted by bolt 38 and falls away from the breech of barrel 12. Bolt 38 and bolt carrier 40 continue to move rearward against the force of bolt carrier return spring 42. Bolt 38 and bolt carrier 40 continue to move rearward even after operating rod 58 is no longer in contact with bolt carrier 40. Operating rod spring 60 translates operating rod 58 forward until operating rod 58 makes contact with piston 52 and moves piston 52 back to its original position in port 54.

Bolt carrier 40 reaches the end of its rearward stroke by contacting a rear surface of receiver 22. Then, bolt carrier return spring 42 moves bolt carrier 40 and bolt 38 forward. On the forward stroke, bolt 38 engages a new cartridge from ammunition magazine 16 and pushes the new cartridge into barrel 12.

Figure 8:
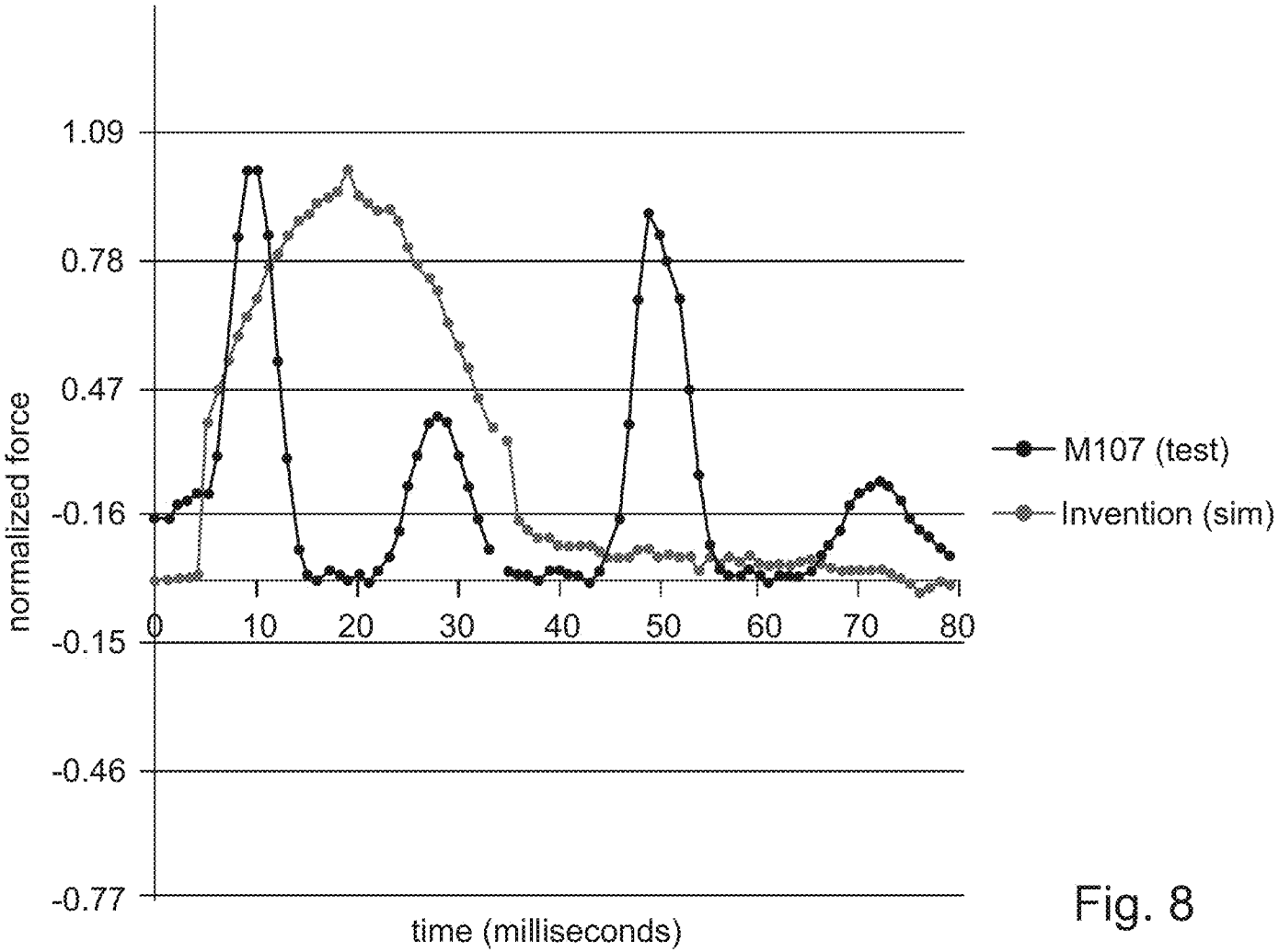
FIG. 8 is plot of recoil force (normalized) versus time for a prior art weapon and for a weapon that includes the inventive recoil reduction apparatus.

FIG. 8 is plot of recoil force (normalized) versus time for a prior art weapon and for weapon 10. The recoil force data for the prior art weapon was measured from live firings of a soft-mounted, .50 caliber M107 rifle equipped with a muzzle brake, a mechanical buffer, and a recoil pad. The recoil force data for weapon 10 was obtained from a computer simulation of a .50 caliber round fired from weapon 10 mounted in a hard mount, without a muzzle brake, without a mechanical buffer and without a recoil pad. Even though weapon 10 (simulated) was hard-mounted and lacked a muzzle brake, mechanical buffer and a recoil pad, the peak recoil forces in weapon 10 were no greater than the peak recoil forces of the soft-mounted .50 caliber M107 rifle equipped with a muzzle brake, a mechanical buffer, and a recoil pad.

While the invention has been described with reference to certain embodiments, numerous changes, alterations and modifications to the described embodiments are possible without departing from the spirit and scope of the invention as defined in the appended claims, and equivalents thereof.

What is claimed is:

1. A weapon having a forward end and a rear end, comprising:

a housing;

a receiver translatably disposed in the housing;

a barrel having one end fixed to the receiver, the barrel being translatable with respect to the housing;

a pair of recoil rods having first ends fixed to the receiver and disposed on opposite sides of the barrel, the recoil rods being translatable with respect to the housing and parallel to the barrel;

respective recoil springs disposed around each recoil rod with first ends of the recoil springs abutting a forward surface of the housing;

a bolt and bolt carrier translatably disposed in the receiver;

a bolt carrier return spring disposed in the housing between the bolt carrier and a rear surface of the housing;

a gas chamber disposed on the barrel, the gas chamber including a piston and a gas port, the gas port including an opening therein;

an operating rod translatably disposed in the opening in the gas port and translatable by the gas piston toward the bolt carrier; and an operating rod spring disposed in the receiver, the operating rod spring biasing the operating rod toward the gas piston.

2. The weapon of claim 1, further comprising an opening in the housing in which the barrel translates.

3. The weapon of claim 2, further comprising two recoil rod openings in the housing in which the recoil rods translate.

4. The weapon of claim 3, further comprising a bolt carrier return rod disposed inside the bolt carrier return spring and extending between the bolt carrier and the rear surface of the housing.

5. The weapon of claim 4, further comprising an opening formed in the barrel adjacent the gas chamber and in fluid communication with the gas chamber.

6. The weapon of claim 5, wherein the operating rod and the piston are not fixed to each other.

7. The weapon of claim 2, wherein the operating rod translates in the opening in the housing in which the barrel translates.

8. The weapon of claim 6, further comprising an opening in the receiver in which the operating rod translates.

9. The weapon of claim 8, further comprising a spring stop on the operating rod, the operating rod being disposed inside the operating rod spring and the operating rod spring being fixed between the spring stop and a surface of the receiver.

10. The weapon of claim 6, further comprising a hand grip fixed to the housing.

11. The weapon of claim 6, further comprising a butt stock fixed to the housing.

12. The weapon of claim 6, further comprising an ammunition magazine removably disposed in the housing.

13. A method, comprising:

providing the weapon of claim 1;

firing a round in the weapon; then translating the barrel and the receiver rearward in unison with respect to the housing;

translating the operating rod rearward with respect to the housing and into contact with the bolt carrier;

translating the bolt and the bolt carrier rearward with respect to the housing until the bolt carrier impacts the rear surface of the receiver;

translating the operating rod forward into contact with the piston; and translating the bolt carrier and the bolt forward.

14. The method of claim 13, wherein the step of translating the operating rod rearward with respect to the housing and into contact with the bolt carrier is performed using propellant gas operating on the piston.

15. The method of claim 14, wherein the step of translating the bolt and the bolt carrier rearward with respect to the housing until the bolt carrier impacts the rear surface of the receiver is performed using force applied by the operating rod.

16. The method of claim 15, wherein the step of translating the operating rod forward into contact with the piston is performed using the operating rod spring.

17. The method of claim 16, wherein the step of translating the bolt carrier and the bolt forward is performed using the bolt carrier return spring.

* * * * *